United States Patent [19]

Rickard

[11] Patent Number: 4,819,280

[45] Date of Patent: Apr. 11, 1989

[54] PORTABLE HANDHELD URINAL AND COMPLEMENTARY FLUSH SYSTEM FOR SAME

[76] Inventor: Paul Rickard, 66 Tennyson Ave., Westbury, N.Y. 11590

[21] Appl. No.: 124,064

[22] Filed: Nov. 23, 1987

[51] Int. Cl.[4] ..... E03D 13/00; A47K 11/12

[52] U.S. Cl. ..... 4/301; 134/166 R; 4/144.1

[58] Field of Search ..... 4/301, 323, 324, 144.1, 4/144.2, 144.3, 144.4, 471, 476, 479, 480, 300.2, 420.1, 434, 455, 114.1; 141/351, 353; 134/166 R, 169 R

[56] References Cited

U.S. PATENT DOCUMENTS

| | | | |
|---|---|---|---|
| 1,075,287 | 10/1913 | Hayworth et al. | 4/300.2 |
| 3,646,617 | 3/1972 | Heald | 4/300.2 |
| 3,757,355 | 9/1973 | Allen et al. | 4/301 |
| 3,855,640 | 12/1974 | Filliung et al. | 4/300.2 |
| 4,145,768 | 3/1979 | Chevrette | 4/144.1 |
| 4,750,219 | 6/1988 | Williams | 4/301 |

*Primary Examiner*—Henry J. Recla
*Assistant Examiner*—J. Casimer Jacyna
*Attorney, Agent, or Firm*—Bauer & Schaffer

[57] ABSTRACT

A handheld urinal and remote flush system for the same is adapted for use by the handicapped. The system comprises a portable bottle and a complementary water closet. The bottle has an upper inlet opening and a lower drain. The lower drain is normally fluid-tightly closed by a valve. The remote closet includes manually operated plumbing that detachably receives the bottle to effect its draining and flushing.

10 Claims, 2 Drawing Sheets

PORTABLE HANDHELD URINAL AND COMPLEMENTARY FLUSH SYSTEM FOR SAME

BACKGROUND OF THE INVENTION

The present invention relates to a portable urinal and more particularly to a handheld urinal for the handicapped with remote complementary means for cleaning and sanitizing the same.

Handicapped people and particularly those in wheelchairs confront obvious difficulties in using a standard bathroom and these problems are particularly acute with public facilities. Thus invalids often times carry their own handheld male or female urinals. However, emptying the contents of such portable devices in a hygienic manner has often been a burden to the user and this problem is compounded with conventional public bathroom facilities because they do not have separate facilities or fixtures to wash the urinal. Generally, prior art urinals merely collect waste and require considerable manual labor to empty and clean the same. For the severely handicapped, and the handicapped who use public bathroom facilities, this presents quite a task.

SUMMARY OF THE INVENTION

The present invention overcomes the above noted drawbacks and provides for a portable handheld urinal and a remote complementary flush and sanitizing unit. In general the present invention comprises a rigid or semi-rigid urine container one end of which is open and preferably formed complementary to the appropriate female or male anatomy. The other and lower end of the urinal comprises a rigid or semi-rigid neck normally closed by an internal valve. A separate fixture or water caddy closet is either permanently placed in a wall or free standing therefrom and connected to plumbing. The caddy closet includes an upper ceiling and a lower floor. A manually operated spray valve and integral head projects from the ceiling, and a drain aperture or seat is built into the floor. The upper spray head and lower drain seat are positioned and configured to allow respective simultaneous attachment thereto of the upper and lower ends of the portable urinal. The drain seat activates or opens the internal valve in the urinal allowing egress of its contents. After the urinal is drained and while its lower end is on the drain seat, the spray valve is inserted into the input or upper end of the urinal and a water spray then rinses the inside of the urinal cleaning and flushing the same. Since the lower end of the urinal remains open and on the drain, spent water automatically drains through this last mentioned end of the urinal. The combination of portable handheld urinals, interchangeable stoppers fitting either male or female urinals, and complementary closet, comprising a self-contained system to hygienically discard waste, cleanse and sanitize urinals in more or less one operation.

It is therefore an object of the present invention to provide a portable handheld urinal for the handicapped.

It is another object of the present invention to provide a portable urinal system that disposes of waste material and then automatically cleans and sanitizes the urinal in more or less one operation.

It is a further object of the present invention to provide a water closet or caddy for a urinal which adapts to existing plumbing, can accept either a male or female urinal, and disposes of the contents thereof in a sanitary way consistant with the needs of the handicapped.

It is one more object of the present invention to provide a portable handheld urinal and complementary hygienic flush system that allows the handicapped to inconspicuously attend to his or her needs, without the assistance of others. Also this hygienic method allows for the emptying and cleansing of the urinal receptacle free of human contact with waste material.

Other objects and features of the present invention will become apparent from the following detailed description considered in connection with the accompanying drawings. It is to be understood, however, that the drawings are designed for purposes of illustration only and not as a definition of the limits of the invention for which reference should be made to the appending claims.

BRIEF DESCRIPTION OF THE DRAWINGS

In the drawings, wherein the same reference numeral denotes the same element throughout the several views.

DESCRIPTION OF THE INVENTION

Figure 1:
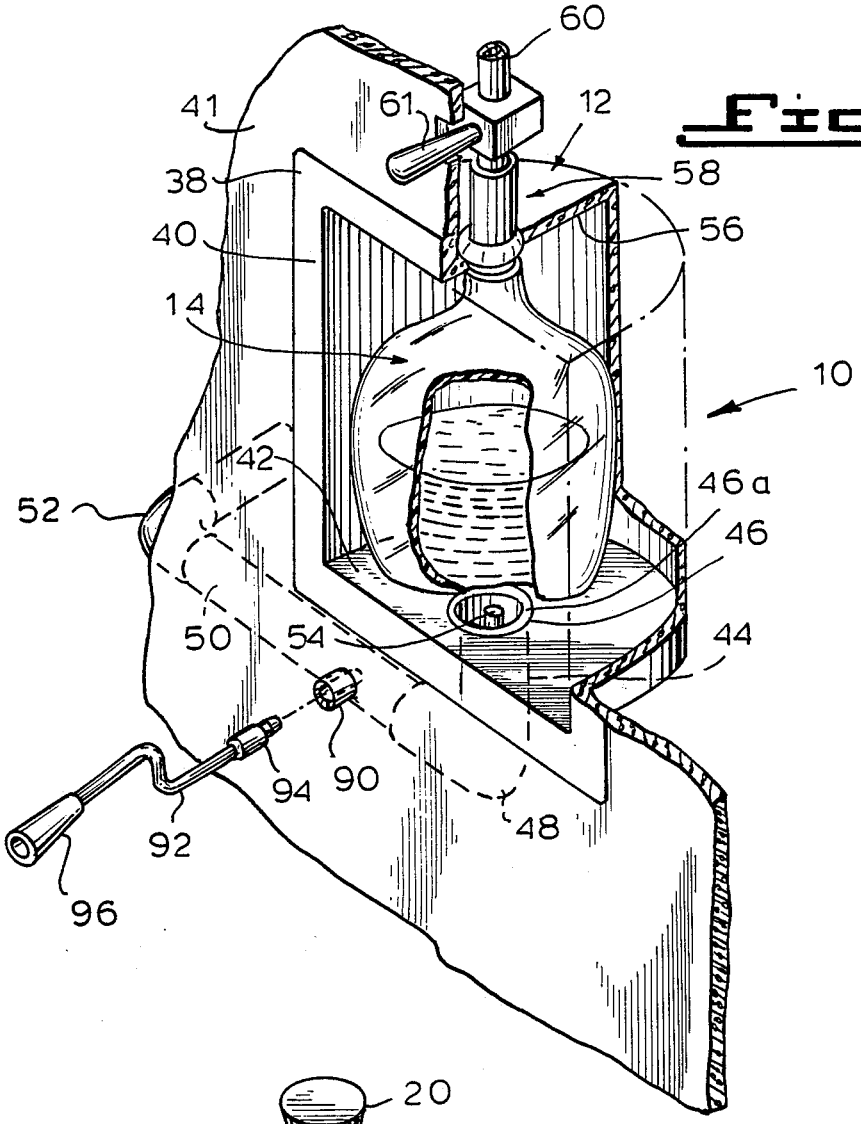
FIG. 1 is a diagrammatic perspective view of the inventive system showing the handheld urinal operatively positioned on the remote water closet.

In detail now and referring to the drawings, the inventive portable urinal and complementary rinse system is indicated generally as reference numeral 10. The system includes a water closet or caddy 12 and a detachable, handheld portable urinal 14.

Figure 2:
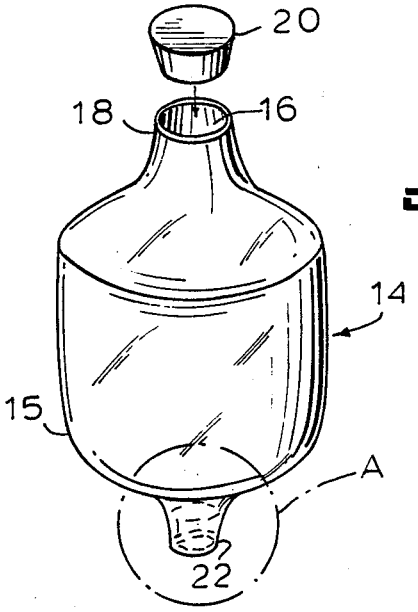
FIG. 2 is a perspective view of the inventive handheld portable urinal container.
Figure 3:
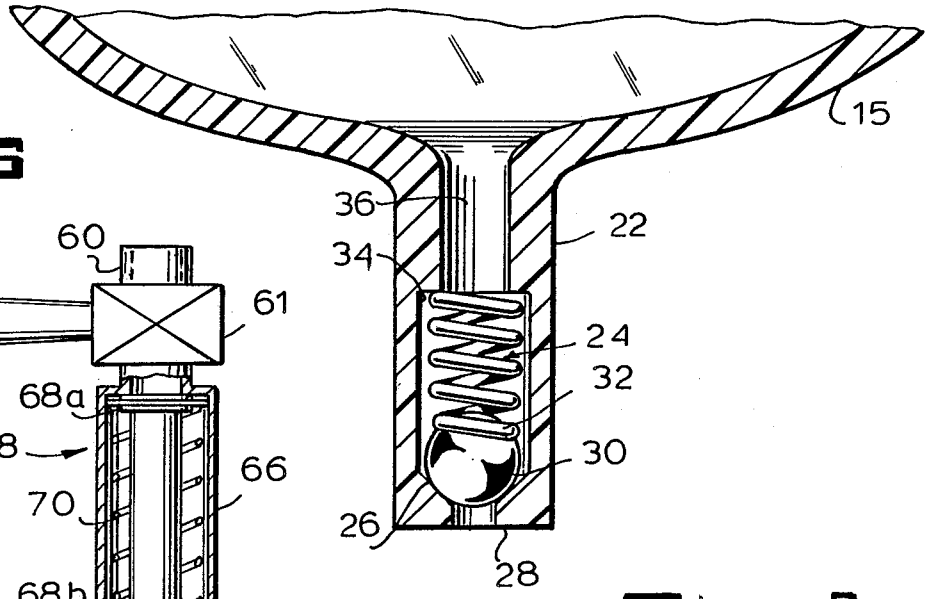
FIG. 3 is an enlarged view, in elevation, of the area designated "A" in FIG. 2 showing the valve arrangement in the lower or discharge end of the urinal.

More particularly, the portable handheld urinal 14 shown in FIG. 2, is in the form of a rigid or semi-rigid bottle 15 preferably of oval shape although the bottle can have almost any configuration. Bottle 15 is defined by an inlet aperture 16 communicating with or formed by a cylindrical open neck passage 18. A cap or plug 20 tightly seats in neck 18 to close the same when urinal 14 is being carried. The lower end of the urinal is defined by a discharge neck 22. Referring to FIG. 3 it will be seen that neck 22 is of elongated cylindrical shape and includes an internal spring loaded valve assembly 24. Valve 24 comprises a conical valve seat 26 and discharge aperture 28 both of which are, preferably, integral with neck 22. A ball 30 is biased into normally closed pressured contact with seat 26 by means of a spring 32. An annular shoulder 34 that includes an aperture 36 reacts on spring 32 causing the latter normally to bias ball 30 into its closed position against seat 26.

Inlet aperture 16 is preferably semi-rigid and of varied circular shapes accommodating either male or female anatomy. However, detachable preformed male and/or female adapters, not shown, can be placed around or in neck 18 thus making urinal 14 more comfortable to use. The adapters may have padded collars and have their outboard open endcontoured to fit a respective male or female user. Also, bottle 15 itself can be made in both male and female configurations.

Remote, complementary water closet 12 comprises a bulkhead or wall part 38 formed with a semi-cylindrical recess or compartment 40 sized to receive urinal 14. Preferably closet 12 is placed in a wall 41 of the bathroom, at a height that is convenient for the user. Recess 40 is defined by a semicircular floor 42. A drain 44 is centrally disposed in floor 42. The drain comprises a drain aperture 46 defined by a beveled lip 46*a* that empties into a drain elbow 48, and the latter is coupled to a drain extension 50. Extension 50 is coupled to a conventional drain pipe 52. A pin 54 extends upwardly in elbow 48. Pin 54 has an outside diameter that is smaller than the diameter of discharge aperture 28 in urinal neck 22. The outside diameter of neck 22 fits snuggly or slightly interferingly with the inside diameter of drain aperture 46, or more particularly, with the aperture defining edge of beveled lip 46*a* and the inside diameter of elbow 48. With this construction, and during operation of the invention as will be described below, water that flushes urinal 14 will exit through valve 24 without splashing from along neck 22.

Figure 4:
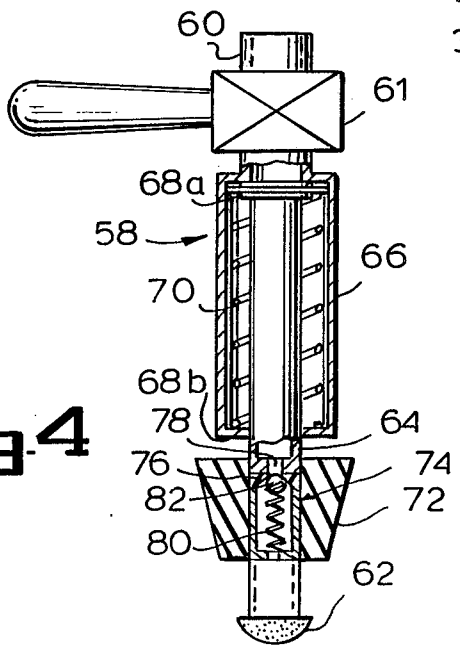
FIG. 4 is an enlarged view, in elevation and partially sectioned of the spray valve and head in inoperative position and it projects from the ceiling of the water closet; and, FIG. 5 is a view similar to FIG. 4 showing the operative position of the spray valve.
Figure 5:
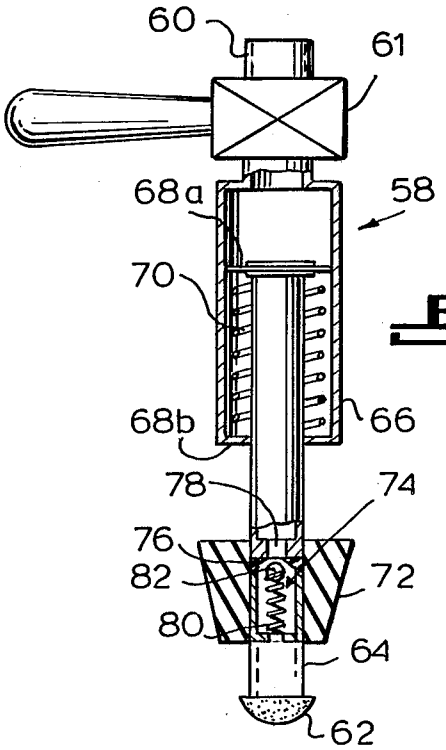

Compartment or recess 40 is further defined by a semi-cylindrical ceiling 56 through which passes a spray valve 58 coupled to a water line 60. The water line 60 is preferably connected to a conventional source of household water through a pressure reducing valve and is provided with a conventional lever operated flushometer valve 61 normally occluding water from passing from the water line 60 into the spray valve 58. As seen in the detail of FIGS. 4 and 5, the lower end of the spray valve 58 terminates in a multi-direction spray head 62 supported on lower end of a feed pipe 64, the upper end of which is slidably and water-tightly received in a housing 66 by means of upper and lower seals 68*a* and 68*b*. Upper seal 68*a* is fixedly attached to pipe 64 and moves therewith in housing 66. A return spring 70 is, on one end, fixedly attached to lower seal 68*b* and the latter is fixedly attached to housing 66. The upper end of the spring 70 is attached to upper seal 68*a*.

A properly shaped stopper 72 is fixedly attached to or formed along the outside periphery of pipe 64 and slightly set back or spaced from head 62. A ball valve assembly 74 is disposed within the pipe 64 and comprises a conical valve seat 76 formed with a centrally placed discharge path 78. A spring 80 biases a ball 82 into a pressured engagement with conical seat 76 normally closing the ball valve assembly 74.

The inoperative position of the spray valve 58 is shown in FIG. 4. In this position, spring 70 retracts the tube 64, upwardly into the housing 66, carrying with it the shaped stopper 72 and the ball valve assembly 74. The ball 82 remains seated by the resilient bias against the seat 76 closing the passage 78. The spray head 82 is lifted upwardly out of the way of the entry position of the bottle 15, allowing the bottle 15 to be easily placed into the drain 46. Since the flushometer 61 is not open, there is no water in the valve assembly 58.

Use and operation of the inventive apparatus is as follows. Handheld bottle 15 is used by the handicapped person as a portable urinal, in substantially the same way as is done with conventional portable urinals. As a portable container, valve apparatus 24 in neck 22 of the urinal 14 remains tightly closed so that it may be filled by the user, and the cap 20 replaced on inlet neck 18, remote from the bathroom without leakage and carried until such convenient time arises to dispose of its contents. When the filled bottle 15 is to be emptied, the content closing cap 20 is removed and the bottle is placed in compartment 40 and while so doing, neck 22 is forced into drain 46. As neck 22 seats on drain 46, pin 54 pushes ball 30 relatively upwardly and off of conical seat 26 opening valve 24 as will be apparent from FIG. 3. Since the pin 54 has a diameter smaller than opening 28, the contents of the bottle 15 will pour through the opening 28 and into drain 48 eventually to be disgorged in pipe 52. Simultaneously with, or after the urinal 14 is emptied, aperture 16 and upper neck 18 of the bottle is brought into alignment with stopper 72 thereby to dispose spray head 62 within the opening 16 of urinal bottle 15.

No cleansing or flushing fluid has yet passed into the bottle. At the will of the user, the user operates the flushometer 61 causing water to pass from the source through inlet pipe 60 into the spray valve 58. The spray valve 58 is occluded by the closed ball valve 74 so that the water does not pass directly to the spray head 62. First, the force of the occluded household water against the seal 68*a* pushes the tube 64 (piston-like). The bias of the spring 70 is overcome and the entire tube 64, the stopper 72 and spray head 62 to move downwardly insinuating the spray head 62 through the neck 18 into the bottle 15, all the while the ball 82 remains closed occluding flow into the spray head 62. When the tube 64 has reached the end of its downward traverse, the force of the water in tube 64 then causes the ball 82 to unseat from seat 76 passing through the discharge path 78 into the spray head 62 from whence it thoroughly cleanses the interior of the bottle 15. Back spray is prevented because the stopper 72 seals the opening neck 18 to the bottle 15.

When the bottle is deemed cleansed, the user releases the flushometer 61 resulting in a decrease in pressure against the ball 82 causing spring 80 to reseat the ball, and sequentially thereafter reduce the pressure against the closed ball allowing the entire tube 64 to retract upwardly, under bias of spring 70 to resume the inoperative position (FIG. 5).

In the foregoing operation, water is not sprayed toward the bottle 15 until the spray head 62 is first fully inserted into the bottle 15 and all spraying is stopped before the head 62 is removed from the bottle 15.

The displacement of head 62 causes moderately pressurized water to flow through pipe 64 and passage 78 eventually to exit as a spray from head 62. As the spray impinges on the internal surfaces of the bottle, it cleans the same. Spent water collects in the lower portion of the bottle whereupon it flows through discharge neck 22 and open valve 24 for collection and discard in drain 44. When the lower end of bottle 15 is then removed from drain 44, the pin 54 is withdrawn from both neck 22 and discharge path 28 causing ball 30 to reseat and seal this discharge path, thereby permitting the bottle 15 to be removed.

Neck 22 and that portion of drain elbow 48 that received the same, should have a linear or axial length that is great enough to maintain the seating of the neck in the elbow as the upper end or neck 18 or bottle 15 is brought into engagement with stopper 72. This will insure that pin 54 keeps valve assembly 24 open during the flush cycle.

Urinal bottle 15 can be made of stainless steel, hard rubber or one of many synthetic materials such as plastic, nylon or the like. In some applications it might be desirable to inject a disinfectant into the liquid that exits from spray head 62. Numerous plumbing assemblies are available for this purpose, and they can be connected at valve assembly 58 or at some other convenient location.

Although it is preferable to place the caddy closet 12 in the wall 41, the closet can be made as a free-standing device with appropriate hardware for detachable engagement to existing plumbing.

For the added convenience of the handicapped, particularly the male handicapped person, the drain pipe 50 is provided with an auxiliary inlet fitting 90 such as female half of bayonet or snap-plug valve, which is normally closed, and to which may be connected a tether line 92, having at one end the mating half or male portion 94 of the bayonet plug valve. The other end of the tether 92 is fitted with a funnel or adapter cup 96, directly useable by the handicapped person to urinate into. The cup 96 may be of any suitable or proper shape but is preferably small enough to be easily portable as for example small enough to fit into a pocket, attache case or a side pocket in a wheel chair. The handicapped person may thus urinate directly into the waste drain, without having to use a bottle or carry a filled bottle. The cup may be removably connected to the tether with similar snap fittings.

Cleansing of the cup 96 and tether 92 can be easily made by inserting the cup 96 over the spray head 62 and against the stopper 72, thereafter activating the flushometer 58. Since the tether 92 is relatively small and portable, it may also be removed and rinsed or flushed in a more conventional manner.

With severely handicapped persons having commodes or other device fitted into their wheel chairs, the tether may be connected to the commode. For females, the cup may be shaped for their convenience. The cup, being smaller than a bottle for both males and females, can be more easily rinsed and cleansed since disposal of the waste is no longer a problem.

While only a few embodiments of the present invention have been shown and described, it is to be understood that many changes and modifications can be made hereto without departing from the spirit and scope hereof.

What is claimed is:

1. A waste disposal system for handicapped persons comprising, a water closet having a water supply port and a discharge drain spaced oppositely to each other, and a waste receiving bottle removably insertable between said water supply port and said discharge drain, said bottle having an inlet at the top and a normally closed outlet at said bottom, said bottle outlet and said discharge drain having cooperating means for opening said normally closed outlet on interaction of said outlet and said drain, said water closet having means for introducing water from said supply port for flushing said bottle with water on interaction of said bottle inlet and said supply.

2. Urinal apparatus for the handicapped, comprising a portable bottle and a remote complementary water closet, said bottle including an upper inlet and a lower outlet, valve means in said lower bottle outlet normally closing the same, said water closet including a closed drain sized to receive said lower bottle outlet, a spray head designed to extend into said upper bottle inlet and flush valve means operable to supply a cleaning liquid to said spray head for cleansing said bottle, and means in said closet drain to activate said valve means when the lower bottle outlet is received in said closet drain whereby the contents of the bottle and said cleaning liquid can exit said lower bottle drain.

3. The apparatus of claim 2 wherein the inlet opening of the bottle includes a neck, the outboard free end of which defines an inlet aperture.

4. The apparatus of claim 3 wherein said spray head is positioned on said flush valve so that when said flush valve is operated the spray head is received in said neck and positioned in said bottle.

5. The apparatus of claim 4 wherein said flush valve includes a valve housing and a pipe, one end of said pipe slideably and fluid-tightly receiving in said housing, said pipe being movable from a retracted position within said housing to an extended position outwardly therefrom on the application of water through said housing, the other end of said pipe extending from said housing and being fixedly attached to said spray head, a stopper sized so as to substantially engage fluid-tightly said inlet aperture and being placed on said pipe at a position external to said housing, said flush valve located internally of said pipe, said valve being biased to open on the application of liquid thereto at a predetermined pressure and remain closed at a pressure less than said predetermined pressure, thereby causing a liquid to exit said spray head and flush the inside periphery of said bottle after said pipe has moved into its extended position.

6. The apparatus according to claim 5 including a manually operated flushometer located at the inlet to said housing to selectively apply water thereto.

7. A portable handheld urinal for use with a remote water closet said water closet having an inlet port for water and an outlet port for drainage that is adapted to flush and sanitize the urinal, said urinal comprising a bottle having an upper inlet neck sized to receive either the male or female anatomy, and a lower discharge path, said discharge path including fluid-tight valve means normally closing the same against discharge of the waste contained within said bottle, said valve having means cooperating with said outlet port for automatically opening said valve when said discharge path is placed in cooperation with the outlet port of the water closet.

8. A water closet that detachably receives and cleans a portable handheld urinal said urinal having an inlet for introducing waste fluid and a normally closed outlet for eliminating said waste fluid, said water closet comprising a bulkhead having recess means to receive the urinal, said recess means including a drain to receive and discard the contents of the urinal, and a manually operated flush valve, said drain and flush valve being aligned along the periphery of said recess to communicate with the outlet and inlet of said urinal upon placement of said urinal within said recess said flush valve including a spray head adapted for placement inside the inlet of said urinal whereby when said valve is opened, a liquid egresses from said spray head washing the inside of the urinal, said drain having means cooperating the normally closed outlet of said urinal to permit opening of said outlet and egress of the liquid from said urinal.

9. The closet of claim 8, said recess means having a spaced upper ceiling and a lower floor, said drain being placed in said floor, and said flush valve being positioned so as to extend from said ceiling.

10. The urinal according to claim 8 including a tether attached to said valve means and a normally closed drain valve mounted with the water closet, said tether having means introduced into said drain valve to discharge fluid from said urinal into said drain.

* * * * *